US008766865B2

(12) United States Patent
Yamamoto et al.

(10) Patent No.: US 8,766,865 B2
(45) Date of Patent: Jul. 1, 2014

(54) ANTENNA DEVICE

(75) Inventors: Shinichi Yamamoto, Tokyo (JP); Shuji Nuimura, Tokyo (JP); Izuru Naito, Tokyo (JP); Toshiyuki Horie, Tokyo (JP); Hiroyuki Sato, Tokyo (JP); Makio Tsuchiya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 216 days.

(21) Appl. No.: 13/382,031

(22) PCT Filed: Oct. 5, 2010

(86) PCT No.: PCT/JP2010/067431

§ 371 (c)(1),
(2), (4) Date: Jan. 3, 2012

(87) PCT Pub. No.: WO2011/048941

PCT Pub. Date: Apr. 28, 2011

(65) Prior Publication Data

US 2012/0098723 A1 Apr. 26, 2012

(30) Foreign Application Priority Data

Oct. 21, 2009 (JP) ..... 2009-242668

(51) Int. Cl.
*H01Q 19/19* (2006.01)

(52) U.S. Cl.
USPC ..... 343/781 P; 343/781 R; 343/912

(58) Field of Classification Search
USPC ..... 343/DIG. 2, 781 P, 781 R, 781 CA, 772, 343/912
See application file for complete search history.

(56) References Cited

U.S. PATENT DOCUMENTS

| | | | | |
|---|---|---|---|---|
| 3,196,442 | A | 7/1965 | Leffelman et al. | |
| 4,369,448 | A | 1/1983 | Satoh et al. | |
| 4,626,863 | A * | 12/1986 | Knop et al. | 343/781 P |
| 4,873,534 | A * | 10/1989 | Wohlleben et al. | 343/786 |
| 6,429,826 | B2 * | 8/2002 | Karlsson et al. | 343/781 P |
| 2002/0011958 | A1 * | 1/2002 | Ogawa et al. | 343/761 |

FOREIGN PATENT DOCUMENTS

| | | | |
|---|---|---|---|
| EP | 0 192 048 | A1 | 8/1986 |
| EP | 1 128 468 | A2 | 8/2001 |
| EP | 1 168 490 | A2 | 1/2002 |

(Continued)

OTHER PUBLICATIONS

International Search Report Issued Jan. 11, 2011 in PCT/JP10/67431 Filed Oct. 5, 2010.

(Continued)

*Primary Examiner* — Tho G Phan
(74) *Attorney, Agent, or Firm* — Oblon, Spivak, McClelland, Maier & Neustadt, L.L.P.

(57) ABSTRACT

An antenna device including: a reflector antenna including a primary radiator, a feed waveguide for feeding radio waves to the primary radiator, and a reflector; and a radome that covers the reflector antenna, in which the antenna device further includes a sidelobe reduction member attached to a vicinity of the primary radiator or the feed waveguide, the sidelobe reduction member reducing a sidelobe in a specific direction of an antenna by at least one of scattering and absorbing of radio waves reflected by the radome out of the radio waves radiated from the reflector antenna. Therefore, it is possible to reduce a sidelobe deterioration caused by reflection waves from the radome.

14 Claims, 6 Drawing Sheets

(56) References Cited

FOREIGN PATENT DOCUMENTS

| | | | |
|---|---|---|---|
| GB | 2 145 569 | A | 3/1985 |
| JP | 56 169905 | | 12/1981 |
| JP | 56 172007 | | 12/1981 |
| JP | 57-42197 | A | 3/1982 |
| JP | 63 169803 | | 7/1988 |
| JP | 6-232582 | A | 8/1994 |
| JP | 2001-24381 | A | 1/2001 |
| JP | 2002-111277 | A | 4/2002 |
| JP | 2003-152435 | A | 5/2003 |
| JP | 2006 217459 | A | 8/2006 |
| JP | 2009-22034 | A | 1/2009 |

OTHER PUBLICATIONS

U.S. Appl. No. 13/381,200, filed Dec. 28, 2011, Yamamoto, et al.
Office Action issued May 21, 2013 in Japanese Patent Application No. 2011-537197 with English language translation.
Extended Search Report issued Mar. 17, 2014, in European Application No. 10824790.9, pp. 1-6.

* cited by examiner

ANTENNA DEVICE

TECHNICAL FIELD

The present invention relates to an antenna device for reducing a sidelobe deterioration caused by reflection waves from a radome.

BACKGROUND ART

Conventionally, as an antenna device of this type, there is an antenna device that reduces sidelobes by attaching a fin-like flat plate to a support structure of a sub reflector (see, for example, Non Patent Literature 1).

CITATION LIST

Non Patent Literature

NPL 1: Toshio Satoh, Shizuo Endo, Naoto Matsunaka, Shinichi Betsudan, Koji Katagi, Takashi Ebisui, "SIDE-LOBE LEVEL REDUCTION BY IMPROVEMENT OF STRUT SHAPE," The Institute of Electronics, Information and Communication Engineers, Technical Report AP81-12, pp. 29-36, May, 1981.

SUMMARY OF INVENTION

Technical Problem

However, in the case of a reflector antenna covered with a radome, if reflection waves are generated at the radome, radome reflection waves are reflected at the reflector so as to increase sidelobes of the antenna. Conventional antenna devices are effective in reducing sidelobes caused by scattering at the support structure of the sub reflector but are not effective for the radome reflection wave.

The present invention has been made to solve the above-mentioned problem, and an object thereof is to provide an antenna device that can reduce a sidelobe deterioration caused by reflection waves from a radome.

Solution to Problem

According to the present invention, there is provided an antenna device, including: a reflector antenna including a primary radiator, a feed waveguide for feeding radio waves to the primary radiator, and a reflector; and a radome that covers the reflector antenna, in which the antenna device further includes a sidelobe reduction member attached to a vicinity of the primary radiator or the feed waveguide, the sidelobe reduction member reducing a sidelobe in a specific direction of the antenna by scattering or absorbing radio waves reflected by the radome out of the radio waves radiated from the reflector antenna.

Advantageous Effects of Invention

According to the present invention, it is possible to reduce the sidelobe in a specific direction of the antenna by scattering or absorbing radio waves reflected by the radome.

DESCRIPTION OF EMBODIMENTS

First Embodiment

Figure 1:
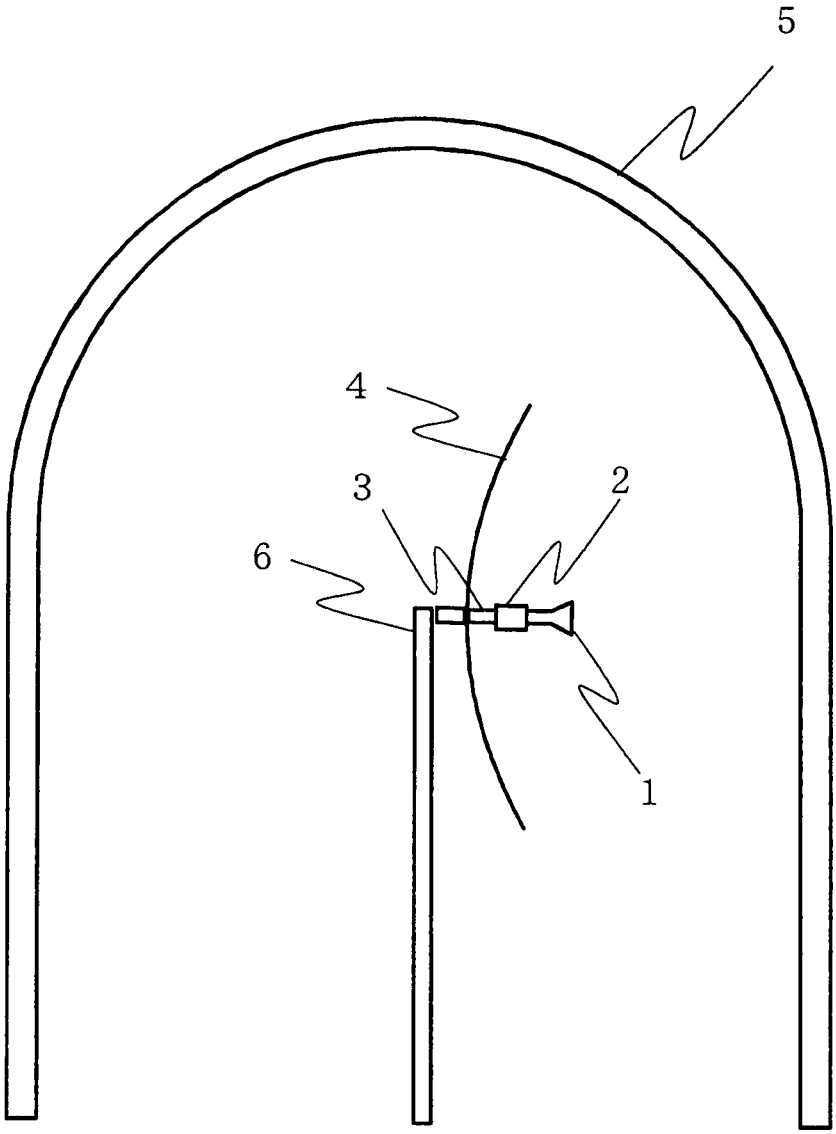
[FIG. 1] A side view illustrating a structure of an antenna according to a first embodiment of the present invention.
Figure 2:
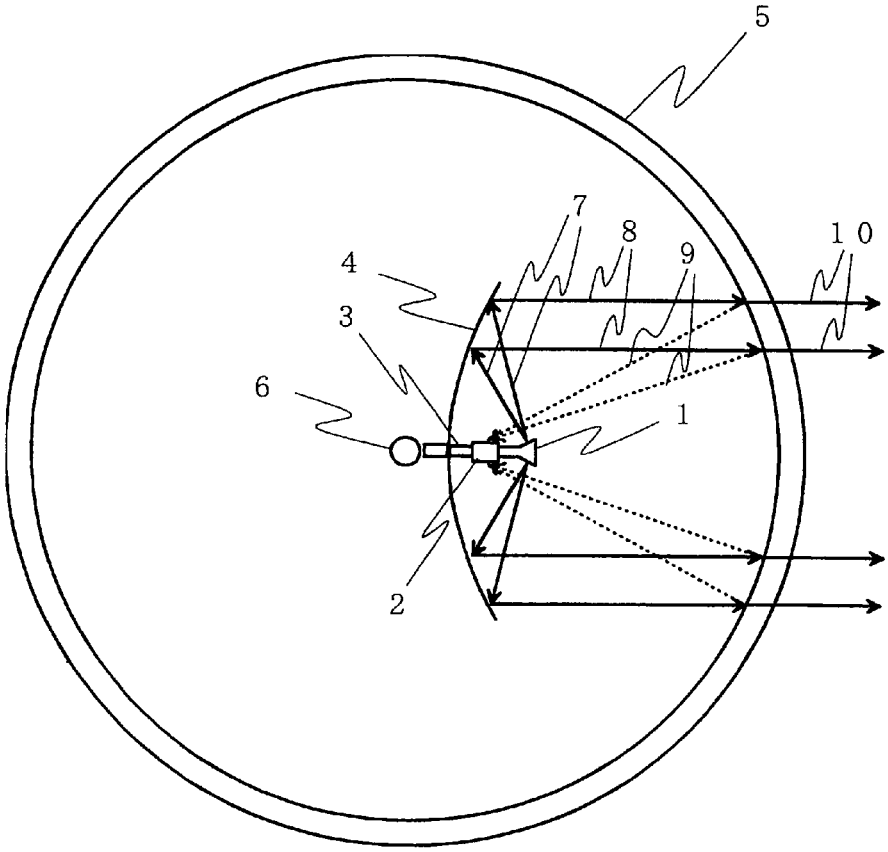
[FIG. 2] Atop view illustrating the structure of the antenna according to the first embodiment of the present invention.

A principle of the present invention is described with reference to FIGS. 1 and 2. FIG. 1 is a side view illustrating a structure of an antenna according to a first embodiment of the present invention, and FIG. 2 is a top view illustrating the structure of the antenna according to the first embodiment of the present invention, which is viewed from the top of FIG. 1. In FIGS. 1 and 2, a radome 5 is disposed so as to enclose a reflector antenna constituted of a primary radiator 1 and a reflector 4. A shape of the radome 5 is a combination of a hemisphere and a cylinder in the diagram but may be an arbitrary shape. In addition, there is illustrated the primary radiator 1 supported by a feed waveguide 3 at the center of the axisymmetric reflector 4, but this is merely an example. An arbitrary antenna structure may be adopted. The primary radiator 1 may be a type of irradiating the reflector 4 via a sub reflector from a primary radiator of a horn antenna or the like, for example, or may be a type of directly irradiating the reflector 4. In the case of the former type, the primary radiator is considered to include the sub reflector. Note that, reference numeral 6 denotes a support post in FIGS. 1 and 2.

In FIGS. 1 and 2, radio waves 7 radiated from the primary radiator 1 are reflected by the reflector 4 to become radio waves 8 directed from the reflector 4 to the radome 5, and further pass through the radome 5 and be radiated therefrom as radio waves 10 passing through the radome 5. A part of the radio waves entering the radome 5 become radio waves 9 reflected by the radome 5 and irradiate an antenna structure. The radio waves 9 reflected by the radome 5 are reflected by a part of the antenna structure and cause a deterioration of a sidelobe in a specific direction of the antenna. The radio waves 9 reflected by the radome 5 are concentrated to a certain extent in a specific spot in accordance with a shape of the radome 5 and the shape of the antenna. For instance, if the radio waves that can be regarded as plane waves enter the radome 5 having a cylindrical shape from the direction perpendicular to an axis of the cylinder, the waves substantially converge at linear positions having a distance from the radome 5 that is approximately half the radius of the radome 5. In addition, if the radio waves that can be regarded as plane waves enter the radome 5 having a hemispherical shape from the direction of the center of the sphere, the waves substantially converge at a spot having a distance from the radome 5 that is approximately half the radius of the radome 5.

If there is a metal antenna structure such as the feed waveguide 3, the primary radiator 1, or the reflector 4 at the spot at which the radio waves 9 reflected by the radome 5 converge, the radio waves 9 reflected by the radome 5 are reflected by the metal structure. The radio waves 9 reflected by the metal structure pass through the radome 5 directly or are reflected by the reflector 4 or the like and then pass through the radome 5 to become a sidelobe in a specific direction of the antenna.

An object of the present invention is to reduce a level of the sidelobe in a specific direction by at least one of scattering and absorbing of the radio waves 9 reflected by the radome 5. If the spot at which the waves reflected by the radome 5 converge is a position at which the feed waveguide 3 or the primary radiator 1 is disposed, a sidelobe reduction member 2 is attached to the vicinity of the feed waveguide 3 or the primary radiator 1 so that the reflecting condition is changed and the direction of generating the sidelobe is changed. The sidelobe reduction member 2 is constituted of a metal structure and scatters or absorbs the radio waves 9 reflected by the radome 5 so as to reduce the sidelobe in a specific direction of the antenna. If a shape of the sidelobe reduction member 2 is changed to be a desired pattern, the direction in which the sidelobe caused by the reflection waves from the radome 5 increases can be changed. In addition, if a shape of the sidelobe reduction member 2 is changed in such a manner that the reflection waves 9 from the radome 5 are scattered, a level of the sidelobe can be reduced.

Therefore, according to the first embodiment, sidelobe deterioration caused by reflection waves from the radome 5 can be reduced by attaching, in the vicinity of the primary radiator 1 or the feed waveguide 3, the sidelobe reduction member 2 for reducing the sidelobe in a specific direction of the antenna by at least one of scattering and absorbing of the radio waves 9 reflected by the radome 5 which are a part of radio waves radiated from the primary radiator 1.

Here, the sidelobe reduction member 2 may be changed to be a structure formed of both of metal and absorbing material or may be changed to be a structure formed only of absorbing material. In the case of metal structure, because the radio waves 9 reflected by the radome 5 are reflected by the structure, the direction of generating the sidelobe is changed, but the sidelobe is generated in a certain direction. If the structure is changed to the absorbing material, a part of the radio waves 9 reflected by the radome 5 are absorbed so that a level of the sidelobe can be reduced. This absorbing material is not necessarily a complete absorbing material. If at least a part of the entering radio waves 9 reflected by the radome 5 are absorbed, this can contribute to reducing the sidelobe. In general, since an attenuation amount of the absorbing material has incident angle characteristics, there is a case where it is difficult to obtain a large attenuation amount, but a greater effect of reducing the sidelobe can be obtained compared to the metal structure. A shape of the absorbing material may be a block shape (lump shape), or the absorbing material may be a plate-like absorbing material. In addition, it is possible to attach absorbing material to the outside of the metal.

Second Embodiment

Figure 3:
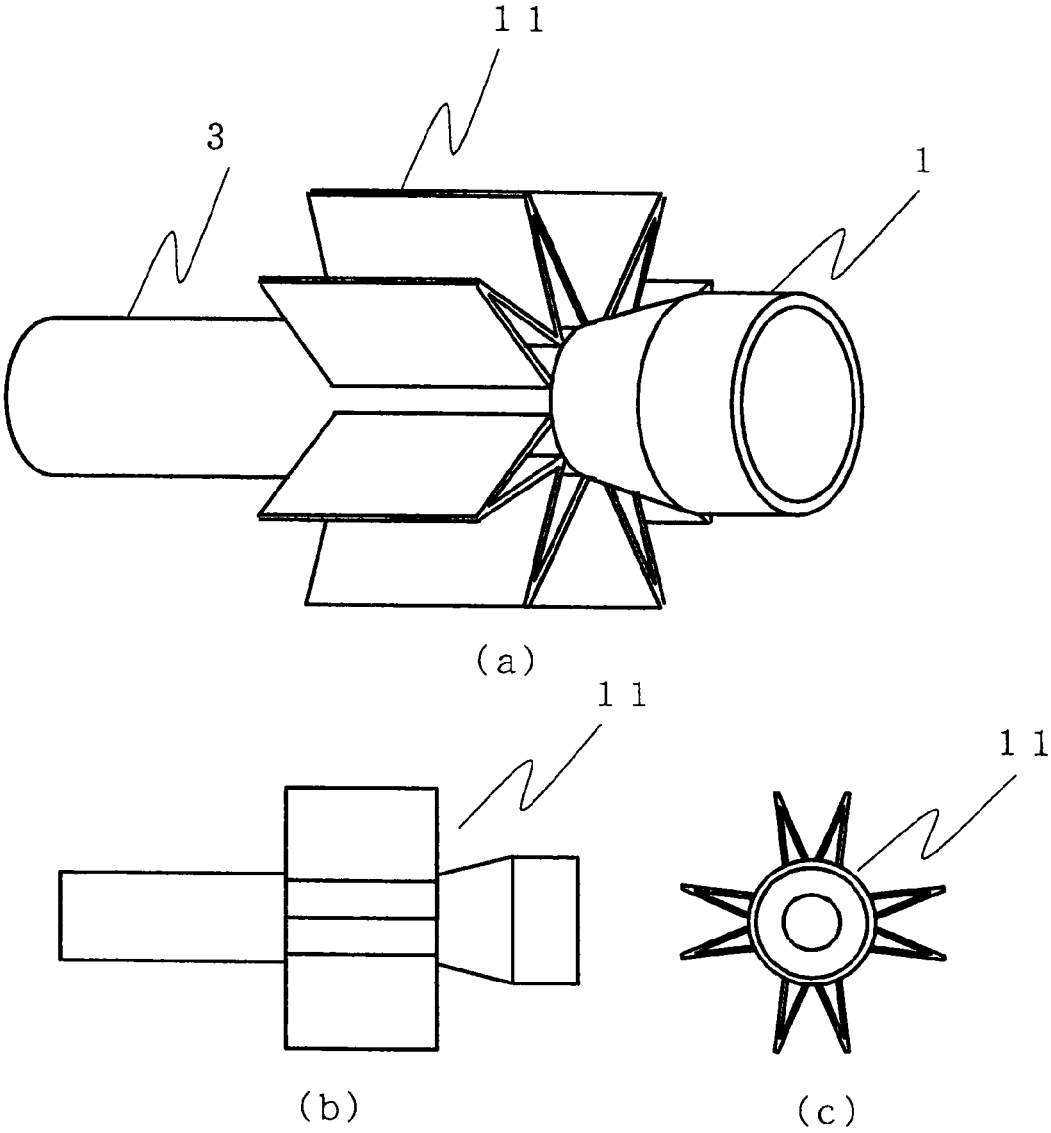
[FIG. 3] Diagrams illustrating a part of an antenna device according to a second embodiment of the present invention and illustrate an example of a specific shape of a sidelobe reduction member 2 illustrated in FIGS. 1 and 2.

FIG. 3 illustrate a part of an antenna device according to a second embodiment of the present invention and illustrate an example of a specific shape of the sidelobe reduction member 2 illustrated in FIGS. 1 and 2. FIG. 3(*a*) is a perspective view, FIG. 3(*b*) is a side view, and FIG. 3(*c*) is a front view. As illustrated in FIG. 3, a plurality of wedge-shaped metal members 11 are attached as the sidelobe reduction member 2 to the vicinity of the primary radiator 1 or the feed waveguide 3 at which the radio waves 9 reflected by the radome 5 converge. The plurality of wedge-shaped metal members 11 are formed by bending a plate metal member and are arranged radially with the axis of the feed waveguide 3 as the center so that the acute angles of the wedges face outward as illustrated in FIG. 3. In FIG. 3, the primary radiator 1 is a conical horn radiator, and the primary radiator 1 is supposed to have another sub reflector. However, it is possible to adopt an antenna of the type in which the radio waves irradiate the reflector 4 directly from the primary radiator 1 or the feed waveguide 3. In addition, FIG. 3 are the diagrams in which eight sheet metal members 11 are attached as the sidelobe reduction member 2. However, the metal member 11 is not limited to the plate member but may be a wedge-shaped block (lump of a wedge filled with metal). Further, the number of the metal wedges, the opening angle of the wedges, the interval of the wedges, the length thereof in the axial direction, and the length thereof in the radial direction are not limited.

Therefore, according to the second embodiment, the wedge-shaped metal members 11 are attached to the primary radiator 1 or the feed waveguide 3, and hence the radio waves 9 reflected by the radome 5 are scattered so that the sidelobe in the specific direction of the antenna can be reduced. In addition, by reducing the length of the wedge in the radial direction, an influence on the radio waves 7 directed from the primary radiator 1 to the reflector 4 can be reduced. In addition, by adjusting the length of the wedge in the axial direction in accordance with an extent of convergence of the radio waves 9 reflected by the radome 5, optimal sidelobe characteristics can be obtained.

Further, FIG. 3 illustrate an example in which the wedge-shaped metal members 11 are used as the sidelobe reduction member 2, but the members 11 may be formed of absorbing material. Further, the wedge-shaped absorbing material is not limited to a plate material but may be a block material (lump of a wedge filled with absorbing material), or the absorbing material maybe attached to the outside of the wedge-shaped metal member 11. Further, the number of the wedge-shaped absorbing materials, the opening angle of the wedges, the interval thereof, the length thereof in the axial direction, and the length thereof in the radial direction are not limited.

By attaching the wedge-shaped absorbing material to the vicinity of the primary radiator 1 or the feed waveguide 3, the radio waves 9 reflected by the radome 5 are absorbed so that the sidelobe in a specific direction of the antenna can be reduced. In addition, by reducing the length of the wedge in the radial direction, an influence on the radio waves 7 directed from the primary radiator 1 to the reflector 4 can be reduced. In addition, by adjusting the length of the wedge in the axial direction in accordance with an extent of convergence of the radio waves 9 reflected by the radome 5, optimal sidelobe characteristics can be obtained. If the sidelobe reduction member 2 is formed of metal, a level of the sidelobe in a specific direction may be increased, but it is possible to achieve improvement on a level of the sidelobe in every direction in the case of the absorbing material.

Third Embodiment

Figure 4:
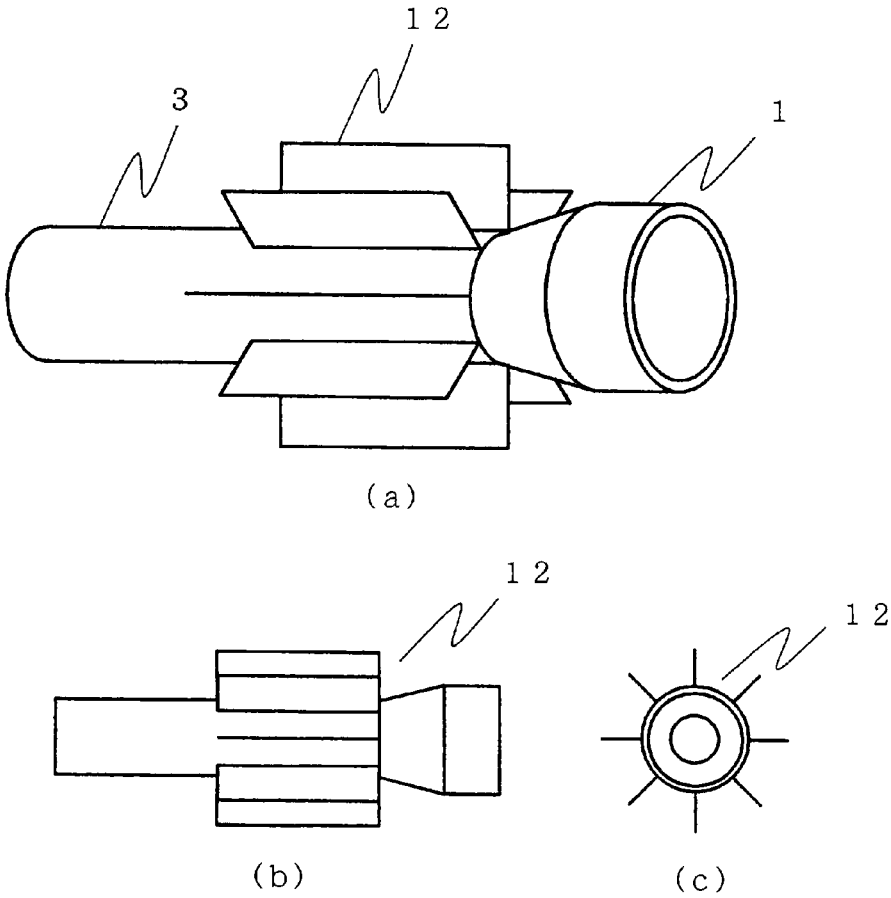
[FIG. 4] Diagrams illustrating a part of an antenna device according to a third embodiment of the present invention and illustrate another example of the specific shape of the sidelobe reduction member 2 illustrated in FIGS. 1 and 2.

FIG. 4 illustrate a part of an antenna device according to a third embodiment of the present invention and illustrate another example of the specific shape of the sidelobe reduction member 2 illustrated in FIGS. 1 and 2. FIG. 4(*a*) is a perspective view, FIG. 4(*b*) is a side view, and FIG. 4(*c*) is a front view. As illustrated in FIG. 4, a plurality flat metal plates 12 are attached as the sidelobe reduction member 2 to the vicinity of the primary radiator 1 or the feed waveguide 3 at which the radio waves 9 reflected by the radome 5 converge. The plurality of flat metal plates 12 are arranged radially with the axis of the feed waveguide 3 as the center. In FIG. 4, the primary radiator 1 is a conical horn radiator, and the primary radiator 1 is supposed to have another sub reflector. However, it is possible to adopt an antenna of the type in which the radio waves irradiate the reflector 4 directly from the primary radiator 1 or the feed waveguide 3. In addition, FIG. 4 are the diagrams in which eight flat metal plates 12 are attached, but the number of the metal plates, the interval thereof, the length thereof in the axial direction, the length thereof in the radial direction, and the thickness of the flat plate are not limited.

Therefore, according to the third embodiment, the flat metal plates 12 are attached to the primary radiator 1 or the feed waveguide 3, and hence the radio waves 9 reflected by the radome 5 are scattered so that the sidelobe in the specific direction of the antenna can be reduced. In addition, by reducing the length of the flat metal plate 12 in the radial direction, an influence on the radio waves 7 directed from the primary radiator 1 to the reflector 4 can be reduced. In addition, by adjusting the length of the flat metal plate 12 in the axial direction in accordance with an extent of convergence of the radio waves 9 reflected by the radome 5, optimal sidelobe characteristics can be obtained.

Further, FIG. 4 illustrate an example in which the flat metal plates 12 are used as the sidelobe reduction member 2, but the plates 12 may be formed of absorbing material. Further, the absorbing material may be attached to both sides of the eight flat plate metals 12 illustrated in FIG. 4. Further, the number of the absorbing flat plates, the interval thereof, the length thereof in the axial direction, the length thereof in the radial direction, and the thickness of the flat plate are not limited.

By attaching the flat plate absorbing material to the primary radiator 1 or the feed waveguide 3, the radio waves 9 reflected by the radome 5 are scattered so that the sidelobe in a specific direction of the antenna can be reduced. In addition, by reducing the length in the radial direction of the absorbing flat plate, an influence on the radio waves 7 directed from the primary radiator 1 to the reflector 4 can be reduced. In addition, by adjusting the length of the absorbing flat plate in the axial direction in accordance with an extent of convergence of the radio waves 9 reflected by the radome 5, optimal sidelobe characteristics can be obtained.

Fourth Embodiment

Figure 5:
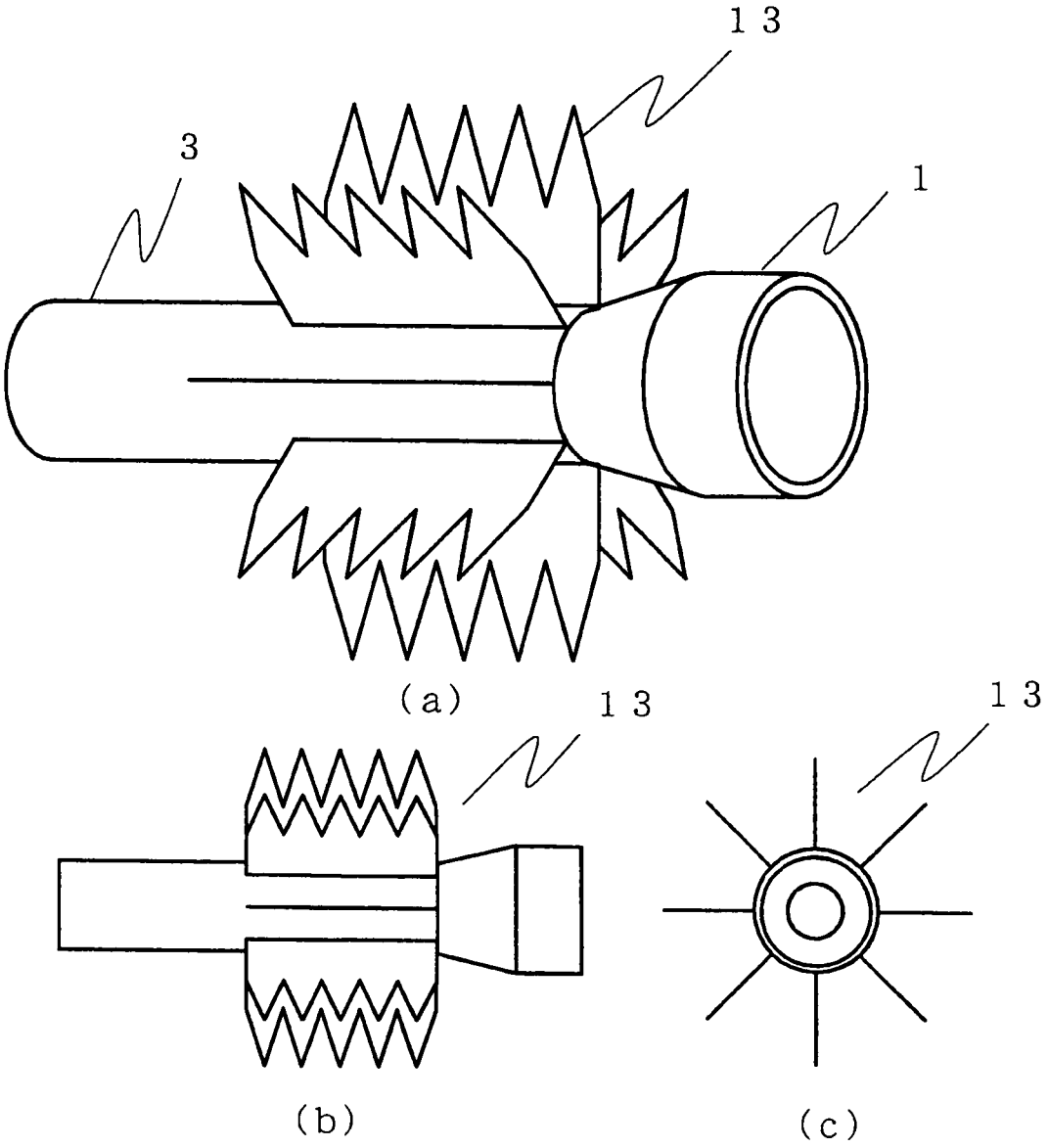
[FIG. 5] Diagrams illustrating a part of an antenna device according to a fourth embodiment of the present invention and illustrate another example of the specific shape of the sidelobe reduction member 2 illustrated in FIGS. 1 and 2.

FIG. 5 illustrate a part of an antenna device according to a fourth embodiment of the present invention and illustrate another example of a specific shape of the sidelobe reduction member 2 illustrated in FIGS. 1 and 2. FIG. 5(*a*) is a perspective view, FIG. 5(*b*) is a side view, and FIG. 5(*c*) is a front view. As illustrated in FIG. 5, flat metal plates 13 having a sawtooth shape are attached as the sidelobe reduction member 2 to the vicinity of the primary radiator 1 or the feed waveguide 3 at which the radio waves 9 reflected by the radome 5 converge. The flat metal plates 13 are arranged radially with the axis of the feed waveguide 3 as the center, and an outer edge thereof is formed in the sawtooth shape along the axis. In FIG. 5, the primary radiator 1 is a conical horn radiator, and it is supposed that the primary radiator has another sub reflector. However, it is possible to adopt an antenna of the type in which the radio waves irradiate the reflector 4 directly from the primary radiator 1 or the feed waveguide 3. In addition, FIG. 5 are the diagrams in which eight sawtooth metal plates are attached as the sidelobe reduction member 2. However, the number of the metal flat plates, the interval thereof, the length thereof in the axial direction, the length thereof in the radial direction, the thickness of the flat plate, the height of the sawtooth, and the interval and the number of the teeth are not limited.

Therefore, according to the fourth embodiment, the flat metal plates 13, which are arranged radially with the axis of the feed waveguide 3 as the center and have the outer edges formed in the sawtooth shape along the axis, are attached to the primary radiator 1 or the feed waveguide 3. Thus, the radio waves 9 reflected by the radome 5 are scattered so that the sidelobe in a specific direction of the antenna can be reduced. In addition, by reducing the length in the radial direction of the metal plate 13, an influence on the radio waves 7 directed from the primary radiator 1 to the reflector 4 can be reduced. In addition, by adjusting the length of the metal plates 13 in the axial direction in accordance with an extent of convergence of the radio waves 9 reflected by the radome 5, optimal sidelobe characteristics can be obtained.

Further, FIG. 5 illustrate an example in which the flat metal plates 13 having the outer edges formed in the sawtooth shape are used as the sidelobe reduction member 2, but the plates 13 may be formed of absorbing material. Further, in FIG. 5, the primary radiator 1 is a conical horn radiator and is supposed to have another sub reflector, but it is possible to adopt an antenna of the type in which the radio waves irradiate the reflector 4 directly from the primary radiator 1 or the feed waveguide 3. Further, it is possible to attach the absorbing material to both sides of the metal plate 13 illustrated in FIG. 5. Further, the number of the absorbing flat plates, the interval thereof, the length thereof in the axial direction, the length thereof in the radial direction, the thickness of the flat plate, the height of the sawtooth, and the interval and the number of the teeth are not limited.

By attaching the absorbing material having such a shape to the vicinity of the primary radiator 1 or the feed waveguide 3, the radio waves 9 reflected by the radome 5 are scattered so that the sidelobe in a specific direction of the antenna can be reduced. In addition, by reducing the length of the absorbing flat plate in the radial direction, an influence on the radio waves 7 directed from the primary radiator 1 to the reflector 4 can be reduced. In addition, by adjusting the length of the absorbing flat plate in the axial direction in accordance with an extent of convergence of the radio waves 9 reflected by the radome 5, optimal sidelobe characteristics can be obtained.

Fifth Embodiment

Figure 6:
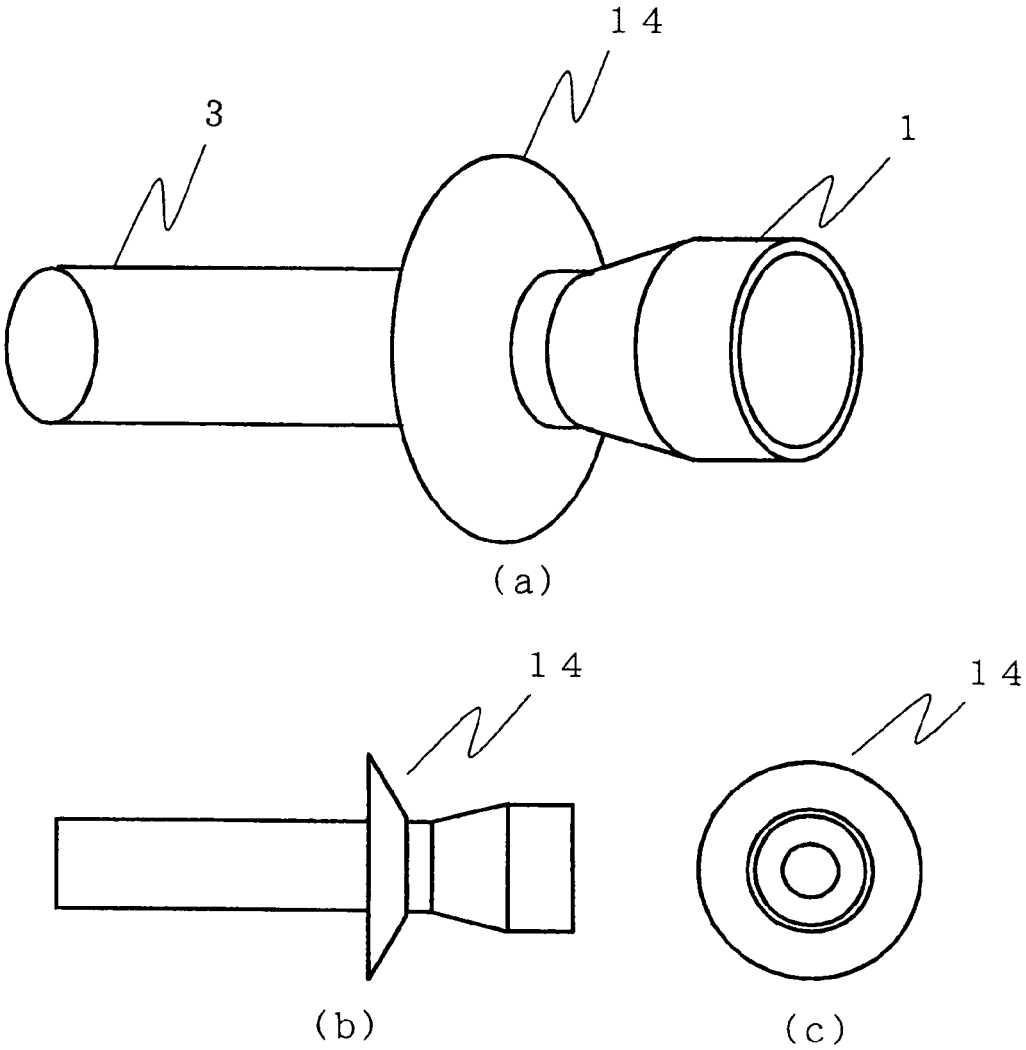
[FIG. 6] Diagrams illustrating a part of an antenna device according to a fifth embodiment of the present invention and illustrate another example of the specific shape of the sidelobe reduction member 2 illustrated in FIGS. 1 and 2.

FIG. 6 illustrate a part of an antenna device according to a fifth embodiment of the present invention and illustrate a specific shape of the sidelobe reduction member 2 illustrated in FIGS. 1 and 2. FIG. 6(*a*) is a perspective view, FIG. 6(*b*) is a side view, and FIG. 6(*c*) is a front view. As illustrated in FIG. 6, metal members 14 having a truncated cone shape are attached as the sidelobe reduction member 2 to the vicinity of the primary radiator 1 or the feed waveguide 3 at which the radio waves 9 reflected by the radome 5 converge. The metal member 14 having the truncated cone shape has the same axis as the feed waveguide 3. In FIG. 6, the primary radiator 1 is a conical horn radiator and is supposed to have another sub reflector. However, it is possible to adopt an antenna of the type in which the radio waves irradiate the reflector 4 directly from the primary radiator 1 or the feed waveguide 3. Further, FIG. 6 illustrate an example of the truncated cone shape, but the truncated cone shape is not limited to a block shape (lump of a truncated cone filled with metal) and may be a plate that forms only the side face of the truncated cone. The diameter of the truncated cone contacting with the feed waveguide 3 or the primary radiator 1 is the same as the outer diameter of the feed waveguide 3 or the primary radiator 1, but the other diameter of the truncated cone and the length in the axial direction (height of the truncated cone) are not limited. Further, FIG. 6 illustrate the truncated cone shape having a smaller diameter on the side closer to the primary radiator 1 and a larger diameter on the side closer to the reflector (a shape opening toward the reflector), but it is possible to adopt the opposite truncated cone shape having a larger diameter on the side closer to the primary radiator 1 and a smaller diameter on the side closer to the reflector (a shape closing toward the reflector). In the case of the plate truncated cone metal, the side having a smaller diameter is fixed to the feed waveguide 3 or the primary radiator 1.

Therefore, according to the fifth embodiment, the truncated cone metal member 14 is attached to the primary radiator 1 or the feed waveguide 3, and hence the radio waves 9 reflected by the radome 5 are scattered so that the sidelobe in the specific direction of the antenna can be reduced. By decreasing the opening angle of the truncated cone, an influence on the radio waves 7 directed from the primary radiator 1 to the reflector 4 can be reduced. In addition, by adjusting the length of the truncated cone metal in the axial direction (height of the truncated cone) in accordance with an extent of convergence of the radio waves 9 reflected by the radome 5, optimal sidelobe characteristics can be obtained.

Further, FIG. 6 illustrate an example in which the truncated cone metal members 14 are used as the sidelobe reduction member 14, but the members 14 may be formed of absorbing material. Further, FIG. 5 illustrates an example of the truncated cone shape, but the truncated cone shape is not limited to a block shape (lump of a truncated cone filled with absorbing material) and may be a plate that forms only the side face of the truncated cone. Further, it is possible to attach absorbing material to the surface or the side face of the truncated cone metal member 14. The diameter of the truncated cone contacting with the feed waveguide 3 or the primary radiator 1 is the same as the outer diameter of the feed waveguide 3 or the primary radiator 1, but the other diameter of the truncated cone and the length in the axial direction (height of the truncated cone) are not limited. Further, FIG. 6 illustrate the truncated cone shape having a smaller diameter on the side closer to the primary radiator land a larger diameter on the side closer to the reflector (a shape opening toward the reflector), but it is possible to adopt the opposite truncated cone shape having a larger diameter on the side closer to the primary radiator 1 and a smaller diameter on the side closer to the reflector (a shape closing toward the reflector). In the case of the plate truncated cone absorbing material, the side having a smaller diameter is fixed to the feed waveguide 3 or the primary radiator 1.

By attaching the truncated cone absorbing material to the vicinity of the primary radiator 1 or the feed waveguide 3, the radio waves 9 reflected by the radome 5 are scattered so that the sidelobe in a specific direction of the antenna can be reduced. In addition, by decreasing the opening angle of the truncated cone, an influence on the radio waves 7 directed from the primary radiator 1 to the reflector 4 can be reduced. In addition, by adjusting the length of the truncated cone metal in the axial direction (height of the truncated cone) in accordance with an extent of convergence of the radio waves 9 reflected by the radome 5, optimal sidelobe characteristics can be obtained.

REFERENCE SIGNS LIST

1 primary radiator, 2 sidelobe reduction member, 3 feed waveguide, 4 reflector, 5 radome, 6 support post, 7 radio wave directed from primary radiator 1 to reflector 4, 8 radio wave directed from reflector 4 to radome 5, 9 radio wave reflected by radome 5, 10 radio wave passing through radome 5, 11 wedge-shaped metal, 12 flat metal plate, 13 flat metal plate having outer edge formed in sawtooth shape, 14 truncated cone metal

The invention claimed is:

1. An antenna device, comprising:

a reflector antenna including a primary radiator arranged along a longitudinal axis;

a reflector arranged along the longitudinal axis so that the longitudinal axis that passes through a center of the reflector and is orthogonal to the reflector at the center of the reflector; and a feed waveguide arranged along the longitudinal axis and between the reflector and the primary radiator, the feed waveguide for feeding radio waves to the primary radiator;

a radome that covers the reflector antenna; and a sidelobe reduction member attached to the primary radiator or the feed waveguide and arranged along the longitudinal axis, the sidelobe reduction member reducing a sidelobe in a specific direction of the reflector antenna by at least one of scattering and absorbing of radio waves reflected by the radome which is a part of the radio waves radiated from the reflector antenna.

2. The antenna device according to claim 1, wherein the sidelobe reduction member is formed of at least one of a metal and an absorbing material.

3. The antenna device according to claim 2, wherein the sidelobe reduction member is formed of a plurality of wedge-shaped members arranged radially around the longitudinal axis so that acute angles thereof face outward.

4. The antenna device according to claim 3, wherein each wedge-shaped member of the plurality of wedge-shaped members extends away from the longitudinal axis and a point of each wedge is a greater distance away from the longitudinal axis than a distance between a base of each wedge and the longitudinal axis.

5. The antenna device according to claim 2, wherein the sidelobe reduction member is formed of a plurality of flat plate members arranged radially around the longitudinal axis.

6. The antenna device according to claim 5, wherein the plurality of flat plate members each have an outer edge formed in a sawtooth shape along the longitudinal axis.

7. The antenna device according to claim 5, wherein each flat plate member of the plurality of flat plate members extends away from the longitudinal axis.

8. The antenna device according to claim 2, wherein the sidelobe reduction member is a truncated cone member arranged along the longitudinal axis.

9. The antenna device according to claim 8, wherein the truncated cone member wraps entirely around the longitudinal axis.

10. The antenna device according to claim 9, wherein the truncated cone member extends away from the longitudinal axis.

11. The antenna device according to claim 1, wherein the sidelobe reduction member wraps around the longitudinal axis.

12. The antenna device according to claim 11, wherein the sidelobe reduction member extends away from the longitudinal axis.

13. The antenna device according to claim 1, wherein the sidelobe reduction member extends away from the longitudinal axis.

14. The antenna device according to claim 1, wherein the sidelobe reduction member is formed of a metal and an absorbing material, and the absorbing material is attached to both front and rear sides of the metal.

* * * * *